United States Patent [19]

St. Onge

[11] Patent Number: 4,890,755

[45] Date of Patent: Jan. 2, 1990

[54] INTERNAL CORROSION PROTECTION OF METAL TANKS

[76] Inventor: Hank St. Onge, 226 Catalina Dr., Scarborough, Ontario, Canada M1E 1B7

[21] Appl. No.: 236,166

[22] Filed: Aug. 25, 1988

[30] Foreign Application Priority Data

Aug. 25, 1987 [CA] Canada ..... 545337

[51] Int. Cl.[4] ..... B65D 6/00; C23F 13/00

[52] U.S. Cl. ..... 220/5 A; 204/148; 204/197

[58] Field of Search ..... 204/148, 197; 220/5 A

[56] References Cited

U.S. PATENT DOCUMENTS 1,512,557 10/1924 Mills ..... 204/197
2,541,062 2/1951 Hoxeng ..... 204/148
3,186,931 6/1965 Marsh et al. ..... 204/197
3,226,314 12/1965 Wellington et al. ..... 204/148
3,562,124 2/1971 Leon et al. ..... 204/148
4,511,444 4/1985 Dukat ..... 204/197

*Primary Examiner*—A. Michael Chambers

[57] ABSTRACT

A corrosion protection system for steel or corrodible metal storage tanks and the like uses two external electrodes which develop a voltage potential used to protect against internal corrosion. One of the external electrodes is connected to an internal sacrificial electrode which is selected such that the rate of corrosion is small and the resulting contamination in the tank is acceptable. The preferred internal electrode is made of a ferro alloy and is connected to the external electrode which has a potential similar to graphite or at least of the same polarity relative to steel. The other electrode is a sacrificial electrode preferrably of zinc or magnesium.

21 Claims, 2 Drawing Sheets

INTERNAL CORROSION PROTECTION OF METAL TANKS

BACKGROUND OF THE INVENTION

This invention relates to corrosion protection systems for corrodible storage vessels and in particular is directed to external and internal corrosion protection systems. Steel storage tanks and particularly buried steel storage tanks for containing liquid products such as petroleum products, are subject to a corrosive environment of the surrounding soil as well as internal corrosion due to the presence of a corrosive liquid within the tank or water within the tank. Therefore, buried steel storage tanks are subject to both external and internal corrosion.

It is known to provide sacrificial electrodes externally of the tank and connected thereto, with the surrounding soil environment completing the circuit between the sacrificial electrodes and the tank. Such sacrificial electrodes slowly corrode in preference to any exposed steel surface of the tank. Such external sacrificial electrodes do not protect the interior surface of the tank from corrosion. Therefore, existing external sacrificial electrodes only protect exposed exterior surfaces which otherwise would corrode.

SUMMARY OF THE INVENTION

According to the invention, a pair of external electrodes are associated with a corrodible metal storage tank with the one electrode being connected to the tank in the manner of a sacrificial electrode to protect against external corrosion. This electrode sacrifices itself and until expended, protects the external surface of the tank. The other external electrode is in electrical association with the sacrificial electrode by means of the surrounding soil environment. These external electrodes create a positive potential relative to steel due to their collective effect of the different electrode materials, and the other electrode is connected to an internal sacrificial electrode located within the tank. The pair of external electrodes serve to draw electrons away from the internal electrode causing the release of positive ions from the internal electrode when a corrosive liquid completes an electrical circuit between the external electrodes, the tank and internal electrode. The positive ions are drawn to the interior surface of the tank. The surrounding soil provides the electrical connection between the external electrodes, and an electrode is being sacrificed externally of the tank and internally of the tank to limit corrosion of the exterior and interior surfaces of the storage tank. It can be appreciated that the internal electrode will be selected to limit contamination of the stored product and the material of the internal electrode may be selected such that the rate of corrosion is small. It is preferred this internal electrode be a ferro-alloy electrode and the tank is of steel.

The present invention provides a system for reducing external and internal corrosion of metal tanks such as steel tanks which, in use, are subject to a corrosive environment either from the surrounding soil or from the product retained within the tank.

The system comprises first and second electrodes located externally of the tank and in contact with the surrounding soil environment. The first electrode is electrically connected to the steel of the tank and the material of the electrode has a negative potential relative to the metal of the tank to impart a positive charge to the exterior of the tank when the first electrode and an exterior metal surface of the tank are connected by a suitable electrolyte. The second electrode is associated with the first electrode and is electrically connected to a suitable internal sacrificial electrode located within and insulated from the interior of the tank. The second electrode cooperates with the first electrode as the second electrode is depleted such that the electrons flow from the internal sacrificial electrode to the second electrode and positive ions associate themselves with the interior of the tank when a corrosive liquid electrically connects the sacrificial electrode with the interior metal of the tank.

The invention has particular application with respect to buried steel tanks where two external electrodes, one of which is directly connected to the tank fo a material to be sacrificed in preference to the exterior of the tank, with the other electrode cooperating with the sacrificial electrode to cause an electron flow to be created between an internal electrode in close proximity to the interior surface of the tank and which sacrifices in preference to the interior of the tank when a corrosive liquid or water electrically connects the internal electrode ans said steel tank, and the external electrodes are connected by an electrolyte.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
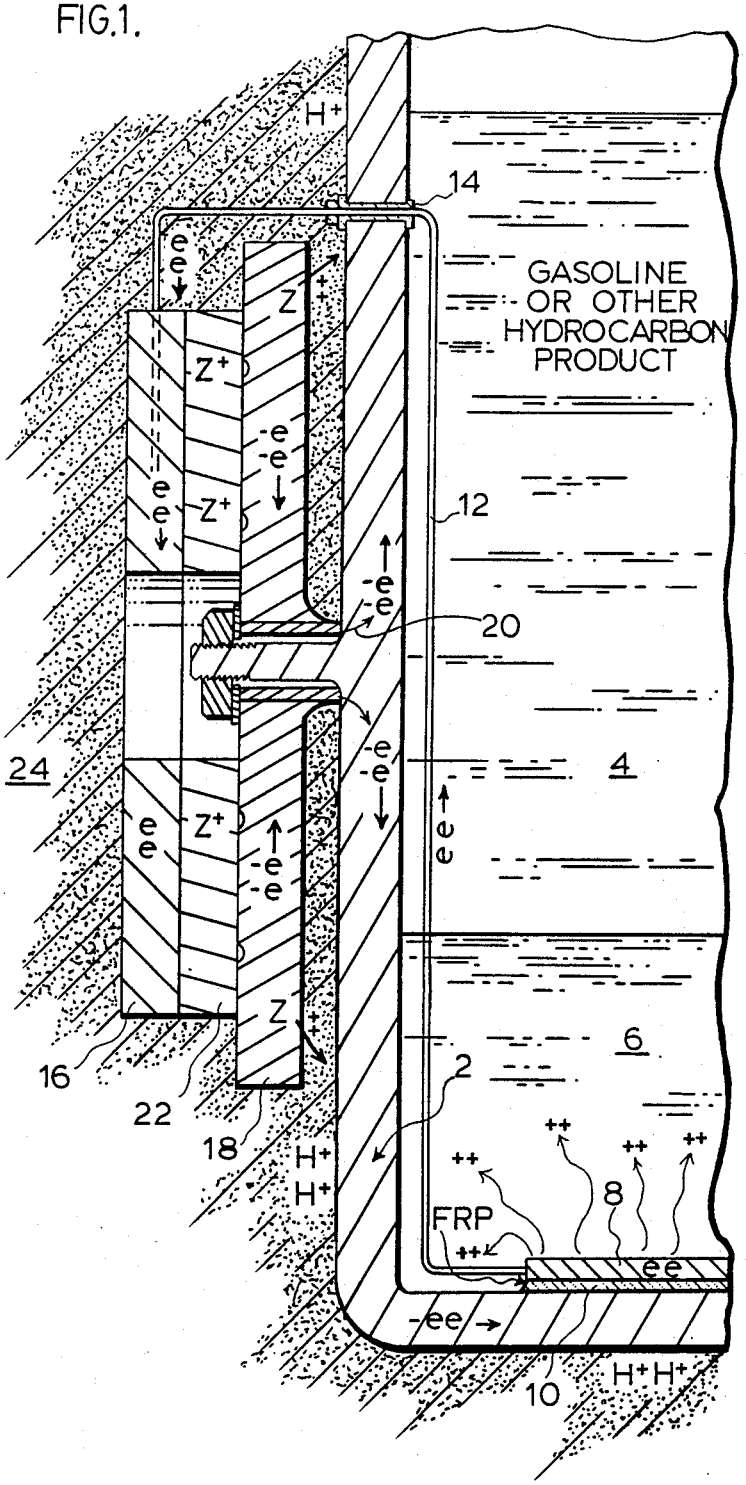
FIG. 1 is a partial cutaway through a steel tank showing the corrosion protection system.

The steel storage tank 2, shown in FIG. 1, stores a petroleum product generally indicated as 4 and a corrosive liquid indicated as 6 is present adjacent to the lower portion of the tank. This corrosive liquid could be water. Water is often present in petroleum products and tends to settle out and accumulate in the lowermost portion of the storage tank.

A sacrificial internal electrode, generally indicated as 8, is placed in close proximity to the internal surface of the bottom of the storage tank and is separated therefrom by an insulating material 10. This sacrificial internal electrode can also act as a wearplate now often added to storage tanks, particularly when used in gas stations where product is loaded into the tank generally directly above the wearplate. The sacrificial internal electrode is electrically connected by connector 12 to an external electrode 16 having a positive potential relative to steel; for example, graphite. The connector 12 passes through an insulated bushing 14 to maintain the internal electrode and the graphite electrode 16 out of direct electrical contact with the steel tank.

A sacrificial electrode 18, preferrably zinc or magnesium, is located exterior to the steel storage tank 2 and is electrically connected to the tank by the electrical-mechanical connector shown as 20. Thus, the sacrificial anode 18 is directly connected to the steel of the storage tank and protects the external surface of the tank from corrosion in the known manner. Electrode 18 is oversized to increase the surface area in contact with the soil and shield the steel of the tank from the graphite electrode.

The graphite external electrode 16 is associated with the sacrificial electrode 18, and held in close proximity thereto. The surrounding soil environment 24 electrically connects the external electrodes 16 and 18.

These external electrodes, electrically connected by the surrounding soil, create a voltage potential therebetween which causes electrons from the internal electrode 18 to be drawn to the graphite electrode via the connector 12 when a corrosive liquid is present within the tank electrically connecting the internal electrode and the interior of the tank. The loss of electrons from the internal electrode will result in positive ions of the internal electrode becoming free in the corrosive liquid, and these ions combine with water creating free hydrogen ions which are drawn to the interior surface of the tank. The zonc electrode electrically connected to the steel storage tank 2 causes electrons to flow to the tank and essentially accumulate adjacent the internal surface of the tank. This arrangement opposes the release of iron ions of the steel storage tank into the corrosive liquid. Electrons have tended to accumulate at the interior surface of the tank creating a negatively charged surface drawn by the positive hydrogen ions released as a result of the corrosion of the internal electrode. The internal electrode 8 is being sacrificed at a slow rate and is protecting the interior surface of the tank which has become negatively charged. The potential driving this circuit is a function of the external electrodes and drawn from the surrounding soil which connects the sacrificial electrode 18 with the graphite electrode 16.

Figure 2:
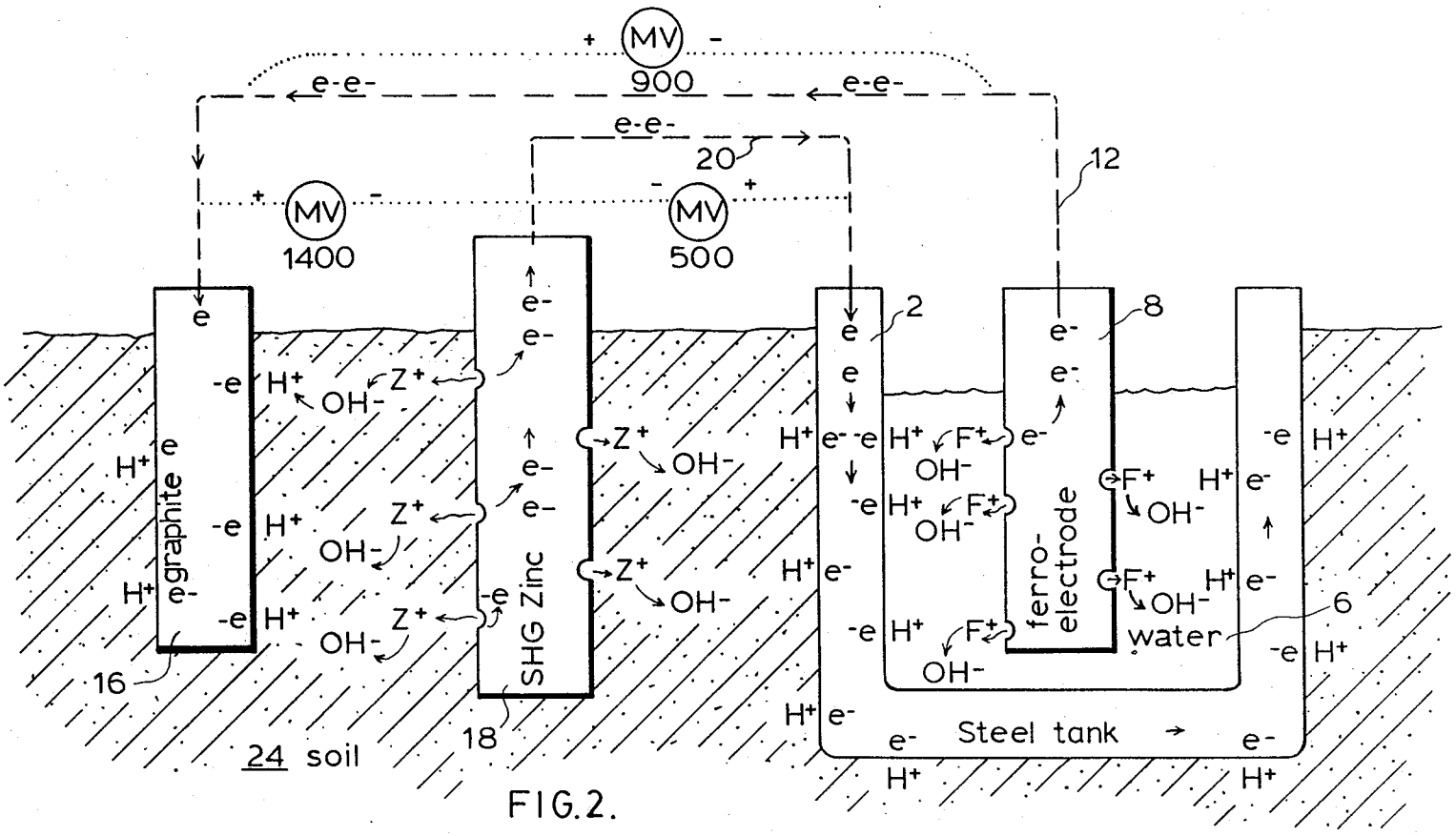
FIG. 2 is a schematic showing the equivalent electrical circuit between the steel and the various electrodes.

The sacrificial electrode 18 additionally functions in its normal manner to protect the external surface of the tank and the details of this can be appreciated from considering the equivalent electrical circuits shown in FIG. 2. Zinc has a negative potential relative to the steel tank and thus electrons from the zinc electrode are drawn to the steel tank when electrolyte is present between the tank and electrode 18. This flow of electrons results in zonc ions being released to the surrounding soil and hydrogen ions accumulate adjacent the external surface of the tank. The graphite electrode 16 receives electrons from the internal electrode 8 and the internal electrode 8 is releasing iron ions into the contents of the steel storage tank. Such ions cooperate with hydroxyl ions of water, freeing hydrogen ions which accumulate adjacent to the interior surface of the tank. In this way, electrons fed by the zinc electrode to the steel of the tank accumulate on both the interior and external surfaces of the tank and oppose any corrosive potential of the steel tank.

As can be appreciated from the above, the requirement of the zinc anode has increased from the demands of the conventional practice and thus the anode is preferably oversized for its new application.

For above ground tanks, the electrodes are buried in the soil adjacent the tanks and the zinc electrode connected to the steel shell of the tank. The graphite electrode is connected as described above. Such an arrangement provides internal corrosion protection using a sacrificial electrode arrangement.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In the corrosion protection of steel tanks, a system for reducing external and internal corrosion of the tank comprising;

first and second electrodes located externally of the tank and in contact with the surrounding soil environment, means electrically connecting said first electrode to the steel of said tank, said first electrode having a negative potential relative to steel to impart a positive charge to the exterior steel of the tank when said first electrode and an exterior steel surface of the tank are connected by a suitable electrolyte, the second electrode being associated with said first electrode and electrically connected to a suitable internal sacrificial electrode located within and insulated from said tank, said second electrode cooperating with said first electrode as said second electrode is depleted such that the electrons flow from said internal sacrificial electrode to said second electrode and positive ions associate themselves with the interior of the tank when a corrosive liquid electrically connects said sacrificial electrode with the interior steel of said tank.

2. In a steel tank as claimed in claim 1, wherein said sacrificial anode within said tank is a ferro-alloy plate.

3. In a steel tank as claimed in claim 2, wherein said first electrode is of zinc and said second electrode is of graphite which are in close proximity to one another, separated by an insulator with the surrounding soil providing an electrical connection therebetween.

4. In a steel tank as claimed in claim 1, 2 or 3, wherein said first and second electrodes are coaxial with one mounted within the other and separated therefrom by a suitable non-conducting porous material.

5. In a steel tank as claimed in claim 1 or 2, wherein said first electrode has a negative potential relative to steel and said second electrode has a positive potential relative to steel.

6. In a steel tank, a corrosion protection system comprising;

first and second external electrodes, said first electrode having a negative potential relative to the steel tank adapted for direct electrical connection thereto, said second external electrode being in close proximity to said first electrode, said second electrode being adapted for electrical connection to a sacrificial electrode located within the tank and insulated therefrom, said first and second electrodes and said internal electrode cooperating, in the presence of an electrolyte within the tank and an electrolyte between said first and second electrodes, to complete an electrical circuit, connecting the internal electrode with the interior of the tank causing free positive ions associating with the interior of the tank whereby the internal electrode is sacrificed to protect the interior of the tank.

7. A corrosion protection system as claimed in claim 6, wherein the first external electrode is of zinc and has associated therewith said second electrode which is made of graphite, said internal electrode being of a ferro-alloy.

8. A corrosion protection system as claimed in claim 7, wherein said internal electrode also acts as a wear-plate located below a filling tube of said tank.

9. A corrosion protection system as claimed in claim 6, wherein said first electrode additionally acts as a sacrificial anode for the exterior of said tank.

10. A corrosion protection system as claimed in claim 9, wherein said tank, when buried in a soil which would otherwise cause corrosion of the external surface of the tank, serves to electrically connect said first and second external electrodes so that the potential between the external electrodes can be transferred to the internal electrode located in the steel tank.

11. A corrosion protection system as claimed in claim 6, wherein said first electrode is of zinc or magnesium.

12. A corrosion protection system as claimed in claim 9, wherein said first electrode is of zinc or magnesium.

13. In the corrosion protection of metal tanks, a system for reducing external and internal corrosion of the tank comprising;

first and second electrodes located externally of the tank and in contact with the surrounding soil environment, means electrically connecting said first electrode to the metal of said tank, said first electrode having a negative potential relative to the metal of said tank to impart a positive charge to the exterior metal of the tank when said first electrode and an exterior metal surface of the tank are connected by a suitable electrolyte, the second electrode being associated with said first electrode and electrically connected to a suitable internal sacrificial electrode located within and insulated from said tank, said second electrode cooperating with said first electrode as said second electrode is depleted such that the electrons flow from said internal sacrificial electrode to said second electrode and positive ions associate themselves with the interior of the tank when a corrosive liquid electrically connects said sacrificial electrode with the interior metal of said tank.

14. In a tank as claimed in claim 13, wherein said sacrificial anode within said tank is a ferro-alloy plate.

15. In a tank as claimed in claim 14, wherein said first electrode is of zinc and said second electrode is of graphite which are in close proximity to one another, separated by a suitable insulator with the surrounding soil providing an electrical connection therebetween.

16. In a tank as claimed in claim 13, wherein said first and second electrodes are coaxial with one mounted within the other and separated therefrom by a suitable porous material.

17. In a tank as claimed in claim 13, wherein said first electrode has a negative potential relative to steel and said second electrode has a positive potential relative to steel.

18. A corrosion protection system for protecting a buried corrodible metal storage vessel and the like comprising;

first and second external electrodes, said first electrode having a sufficient negative potential relative to the metal of the storage vessel to corrode in preference to the metal of the vessel when electrically connected therewith, said second external electrode cooperating via a direct electrical connection with an internal electrode, and cooperating with said first electrode and said tank to form an electrical circuit when a corrosive liquid is within said tank and in contact with said second electrode and a suitable electrolyte connects said external electrodes to negatively charge interior and exterior surfaces of the tank which otherwise would be subject to corrosion.

19. In combination, an internal corrosion protection system and an external corrosion protection system for a common steel buried vessel subject to internal and external corrosion, said internal and external corrosion protection system having a common external electrode of a suitable sacrificial material relative to steel and electrically connected to said vessel, said internal corrosion protection system additionally including a further external electrode directly connected to an internal sacrificial electrode within the vessel and in close proximity to an internal surface to be protected, said common electrode cooperating with said further external electrode, said internal electrode, and said vessel to apply a charge to the internal surface of the vessel when a corrosive electrolyte connects said vessel and said internal electrode and an electrolyte connects said external electrodes.

20. In combination as claimed in claim 19, wherein said external corrosion protection system cooperates with said internal corrosion protection system to cause a synergistic action therebetween.

21. An internal and external corrosion protection system connected to a buried steel tank comprising two external electrodes, one of which is directly connected to said tank and of a material to be sacrificed in preference to the exterior of the tank, said other external electrode cooperating with said sacrificial electrode to cause an electron flow to be created between an internal electrode in close proximity to the interior surface of the tank and which sacrifices in preference to the interior of the tank when a corrosive liquid or water electrically connects the internal electrode and said steel tank and said external electrodes are connected by an electrolyte.

* * * * *